US005517778A

United States Patent [19]

Simson

[11] Patent Number: 5,517,778

[45] Date of Patent: May 21, 1996

[54] MULTI-ROLLER SCROLLING DISPLAY APPARATUS

[76] Inventor: Anton K. Simson, 13227 Aubrey St., Poway, Calif. 92064

[21] Appl. No.: 242,965

[22] Filed: May 16, 1994

Related U.S. Application Data

[63] Continuation-in-part of Ser. No. 195,394, Feb. 14, 1994, which is a continuation-in-part of Ser. No. 67,738, May 26, 1993, Pat. No. 5,410,330.

[51] Int. Cl.[6] ..... G09F 11/18

[52] U.S. Cl. ..... 40/471; 242/538.2; 242/613.3

[58] Field of Search ..... 40/471, 518, 117; 242/538.2, 538.3, 613.3

[56] References Cited

U.S. PATENT DOCUMENTS

| | | | |
|---|---|---|---|
| 649,459 | 5/1900 | Johnson | 40/471 |
| 778,347 | 12/1904 | Anderson | 40/471 |
| 1,073,927 | 9/1913 | Popp | 40/471 |
| 3,613,275 | 10/1971 | Caferro | 40/471 |
| 3,616,554 | 11/1971 | Singer et al. | 40/471 |
| 3,726,031 | 4/1973 | Singer | 40/471 |

*Primary Examiner*—Joanne Silbermann
*Attorney, Agent, or Firm*—Henri J. A. Charmasson; John D. Buchaca

[57] ABSTRACT

A device for displaying a scrollable banner wherein the single banner pick-up roller used in prior art devices is replaced by a multi-roller spool. Each multi-roller spool comprises at least two rollers connected with spool belts which define a winding area much longer than that of any single roller. The spools are rotatably mounted within a display housing. Motors drive the multi-roller spools. Additional features include: convex style crowned pulleys for automatically centering each of the spool belts, a centrally located roller separator mechanism which gives a convex crown structure to the entire spool itself whereby the banner is automatically centered, and a display housing of far reduced depth.

31 Claims, 9 Drawing Sheets

MULTI-ROLLER SCROLLING DISPLAY APPARATUS

PRIOR APPLICATION

This is a continuation-in-part application of application Ser. No. 08/195,394 filed Feb. 14, 1994 which is a continuation-in-part application of application Ser. No. 08/067,738 filed May 26, 1993, U.S. Pat. No. 5,410,330.

FIELD OF THE INVENTION

This invention relates to mechanisms for driving a display or recording medium scrolling between two pick-up spools.

BACKGROUND OF THE INVENTION

Referring now to FIG. 1, a scroll or tape 1, bearing a number of banners or signs that is alternately wound back-and-forth between a pair of rotatably mounted rollers 2, 3 are commonly used on chart recorders, advertising displays and other devices where information must be continuously or intermittently displayed.

These devices typically suffer from size constraints. Since essentially the entire scroll is at some time wound exclusively on one of the two rollers, each roller must be capable of bearing the weight of an entire scroll of multiple banners, and the apparatus housing 4 must be large enough to accommodate both rollers having the scroll fully wound thereon. In particularly large banner displays with banner widths exceeding several feet, the weight and cumulative tension of the fully wound scroll may cause the roller to bend in the center since it is usually rotatively supported on spindles at either end. This in turn causes unequal rolling and tensioning of the scroll which causes it to prematurely wear out. Combating this problem by strengthening the roller structure usually costs too much and increases the overall size of the apparatus beyond acceptable limits.

It would therefore be desirable to have a lightweight, inexpensive banner display device which has a shallow outer dimension and which is capable of displaying portions of scrolls of great length and width without undue cost or premature scroll wear out.

SUMMARY OF THE INVENTION

The principal and secondary objects of this invention are to provide a thin, compact, lightweight and inexpensive banner display apparatus which can display scrolls of heretofore unattainable lengths and widths without suffering from the drawbacks described above.

These and other objects are achieved by replacing the single pick-up roller used in the prior art displays with a multi-roller spool. Each multi-roller spool comprises at least two rollers connected with spool belts which define a scroll winding circumference greater than that of any single roller. The spools are rotatively mounted within a display housing. Motors drive the multi-roller spools. Additional features include: convex style crowned pulleys for automatically centering each of the spool belts, a centrally located roller separator mechanism which gives a convex crown structure to the spool itself whereby the scroll is automatically centered, and a housing of far reduced depth over that of the prior art.

DESCRIPTION OF THE PREFERRED EMBODIMENT OF THE INVENTION

Figure 1:
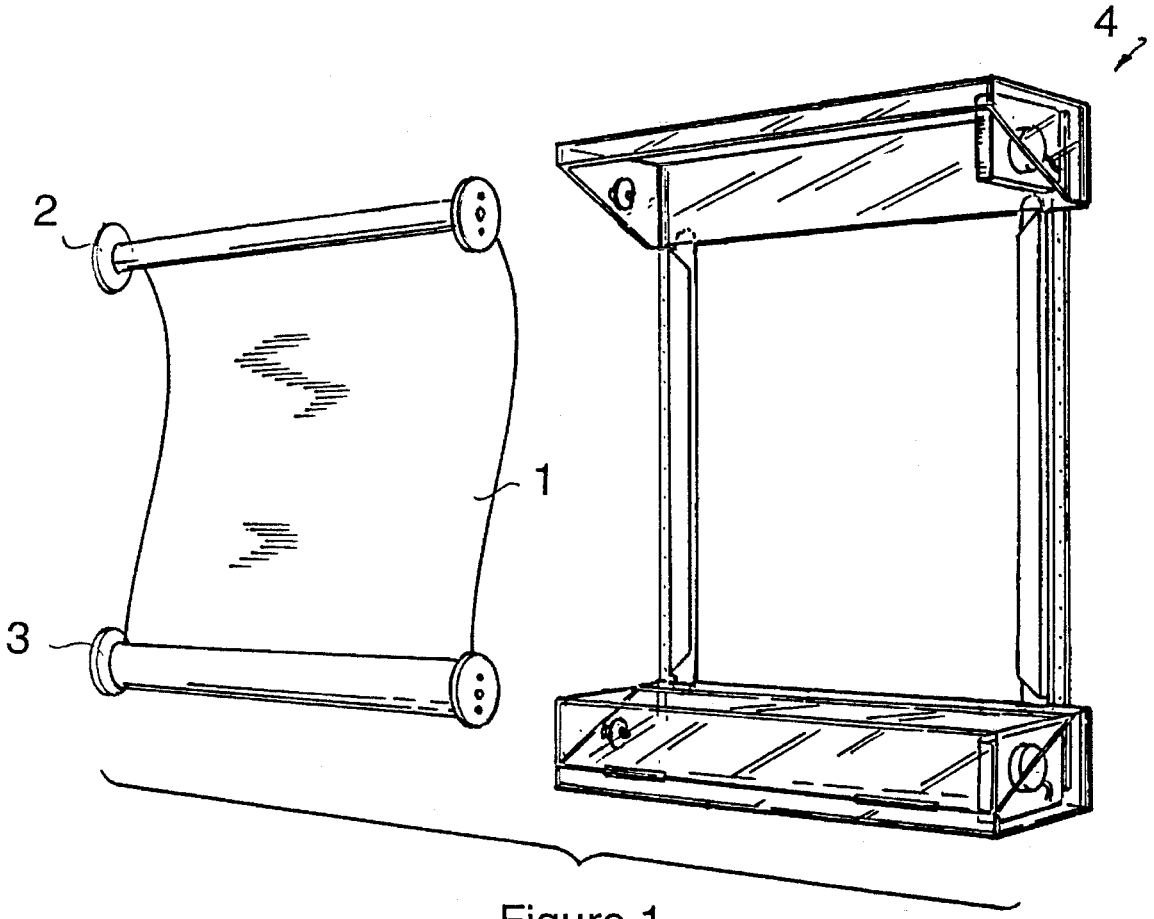
Figure 1 Prior Art
FIG. 1 is a perspective view of a banner display device typical in the prior art having single roller pick-up spools.
Figure 2:
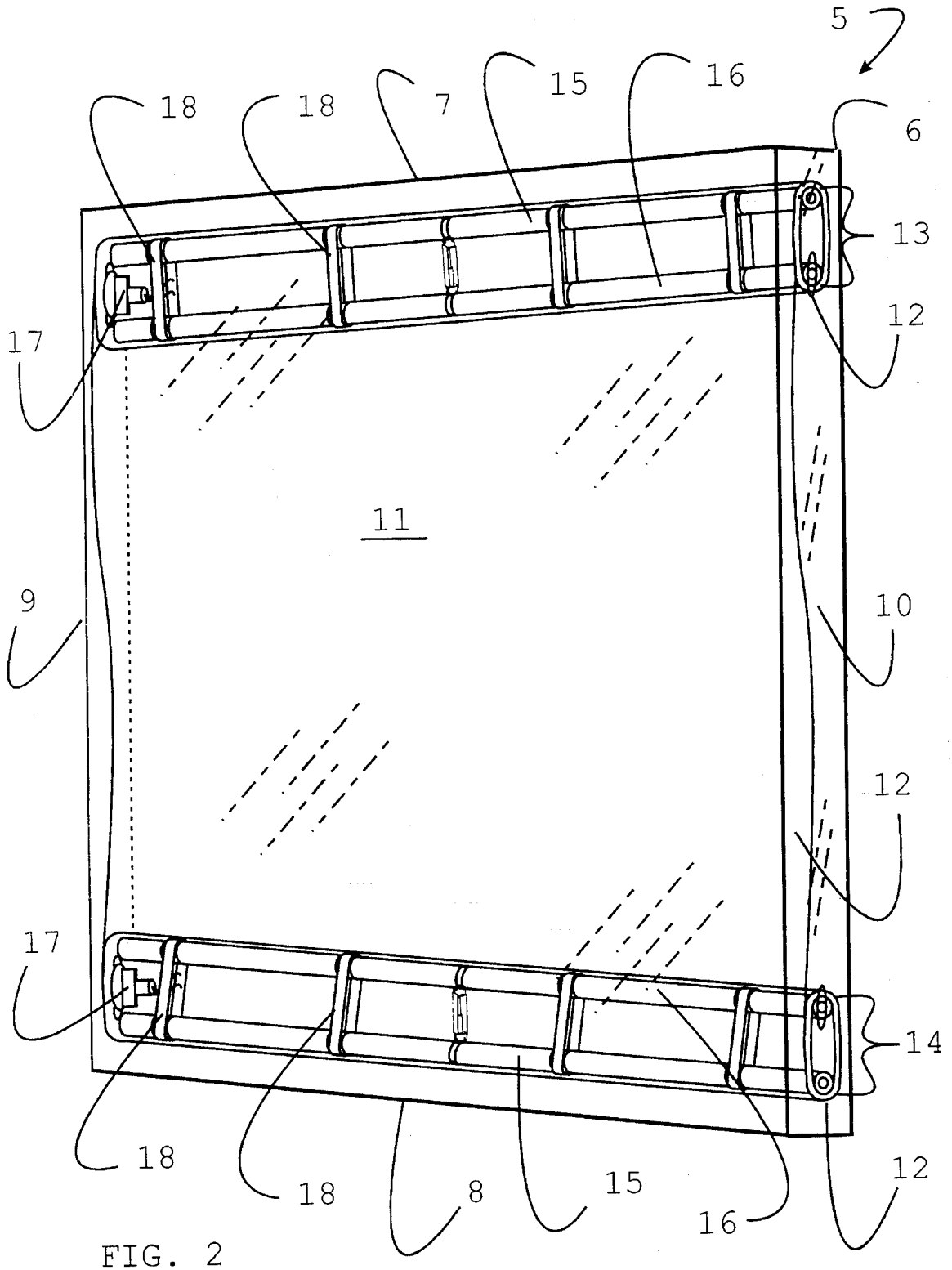
FIG. 2 is a perspective view of a banner display apparatus having dual roller pick-up spools according to the invention.

Referring now to the drawing, FIG. 2 shows a banner display apparatus 5 having a generally quadrangular enclosure or housing 6 made of a rigid material such as metal or plastic. The enclosure is oriented in an upright position, having top 7, bottom 8 and side 9, 10 panels. This orientation is primarily to facilitate description in this specification. This in no way precludes operating the apparatus in other orientations. It has a transparent front viewing panel 11 or open window with height and width dimensions substantially equal to the portion of the scroll 12 being displayed.

Located at the top and bottom of the enclosure are first and second multi-roller take-up spools 13, 14 upon which is wound a scroll 12 containing a number of banners or individual signs to be displayed. Each spool comprises a rotatively mounted drive roller 15 parallelly spaced apart from a rotatively mounted floating roller 16. The drive roller is connected to a motor 17. Stretched between the drive roller and floating roller are a plurality of spooling belts 18 which define the circumferential surface upon which the scroll will be wound. Both rollers are made of a rigid material such as metal or plastic while the spool belts are made from strips of pliable and preferably slightly resilient sheet material.

Figure 3:
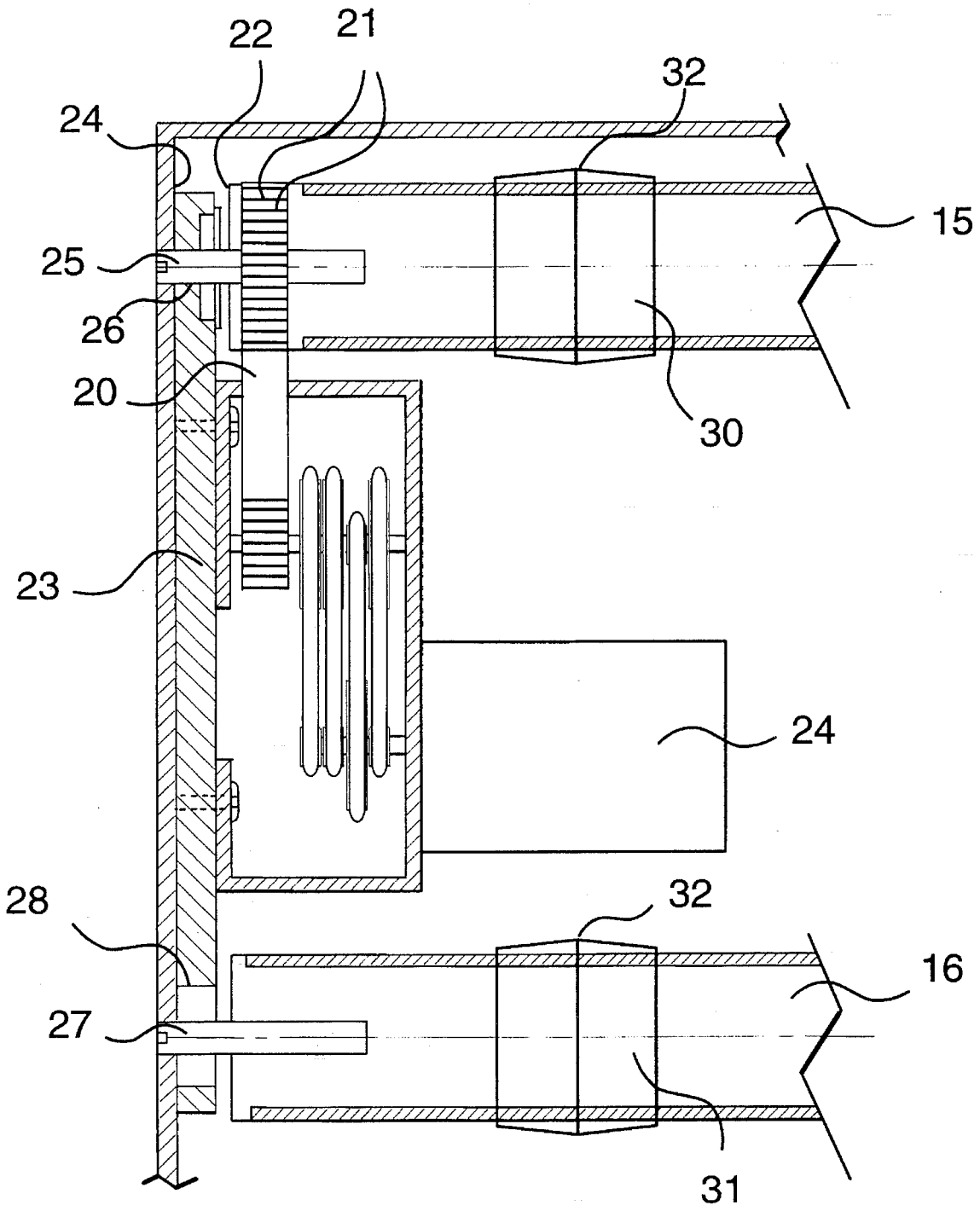
FIG. 3 is a close-up, partial cut-away diagram of the front view of one end of the upper spool from FIG. 2.
Figure 4:
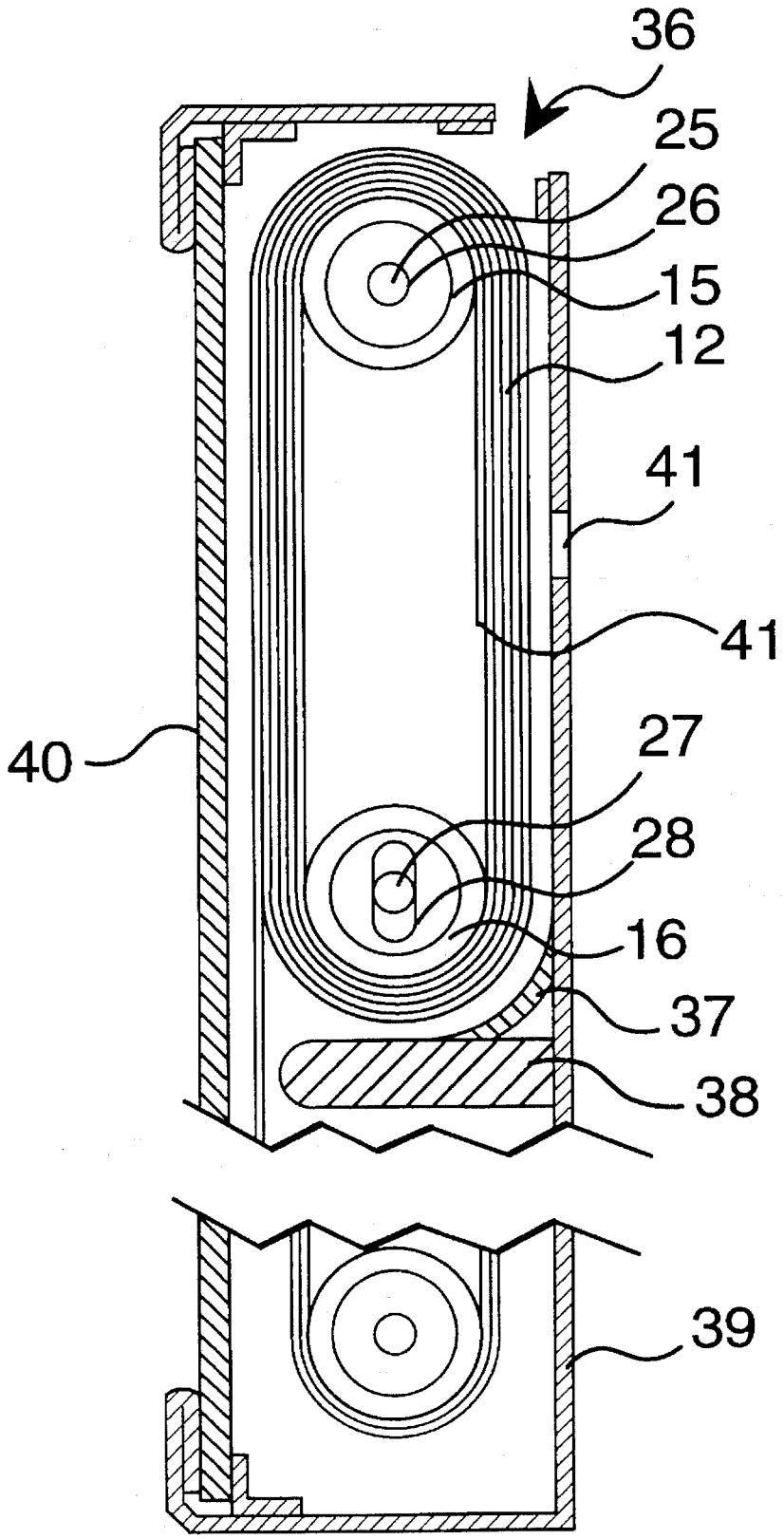
FIG. 4 is a partial cut-away diagram of the right side view of the upper spool from FIG. 2.

FIG. 3 and 4 show the drive roller 15 and floating roller 16 may be separated enough to allow placing the drive motor 17 within the boundary of the banner carrying portion of the spool. The motor is mechanically connected to the drive roller by a drive belt 20. The drive belt has teeth along its inner track which engage a gear in the motor and gear teeth 21 placed circumferentially around the drive roller. About the arcuate section of the drive belt in contact with the drive roller, the outer dimension of the belt is substantially level with the adjacent outer surfaces of the roller. The side edge of the scroll can therefore extend to the end 22 of the roller without the drive belt interfering with the scroll. If the spool bearing end-plate structure 23 is designed with an oval shape so that it fits within the oval circumferential track of the end of the scroll, the banner side edge can then extend all the way to the inner edge of the side panel 24 of the apparatus. Prior art designs require reserving additional space beyond the width of the scroll for mounting the drive motors which engage the single rollers.

Since the edges of the apparatus and the front screen are in effect the substantial dimensions of the viewing window, the front panel and side panels act as guides for the scroll on its entire trip across the front viewing screen.

FIG. 3 and 4 also show that the cylindrical drive roller 15 has an axial spindle 25 at either end for engaging a circular hole 26 in the spool bearing end plate 23. The floating roller 16 has an axial spindle 27 which engages an oval slot 28 in the spool bearing end-plate which allows limited movement up and down. It is clear that the features may be reversed such as the spool bearing end plate having the protruding axial spindle and the roller having a mounting hole without departing from the invention.

Figure 5:
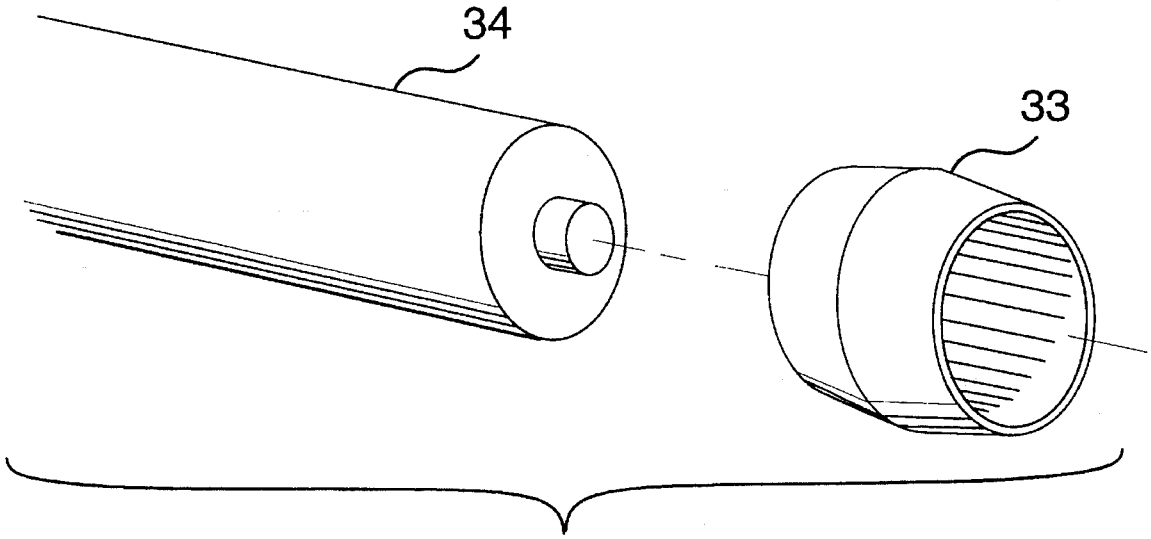
FIG. 5 is a perspective view of a detached spool belt bearing pulley and the end of a roller.

Each spooling belt is kept in place by riding on a pair of convex crowned spool belt bearing pulleys 30, 31, positioned substantially across from each other in a parallel, adjacent, non-offset configuration, one on the drive roller 15, and the other on the floating roller 16. As a spooling belt tends to run to either side of the pulley, the tension increases on the side of the belt traveling toward the central crown 32, which encourages it to travel back to its original position. Depending on the width and pliability of the particular scroll being displayed, the user may choose to add additional pulleys and spool belts to both rollers by simply repositioning the existing pulley/belt combinations, thereby making room for the additions. Each pulley is made from a resilient material such as plastic or rubber. FIG. 5 shows a pulley 33 is sized and dimensioned to be easily pressed into position on a roller 34 by hand. Because the spooling belts are self-centering, they do not have to be as tight or made to exacting tolerances and are therefore less expensive.

Because the spool provides a greater length-wise surface area for contact of the end of a roller, it is easier to begin the roller winding onto a spool. This allows the scroll to be self-loading requiring no firm attachment of the end of a scroll onto the spool. FIG. 4 shows how the end of a scroll 29 may simply be inserted through an oblong slot 36 extending along the entire width of the enclosure. The slot leads directly to a long dimension of the spool. As the spool begins turning, the end of the scroll will begin to catch on the surfaces of the spool. When the end of the scroll reaches the floating roller 16 a curved deflector 37 facilitates the end making the turn.

An elongated rigid brace 38 extending from the back 39 of the apparatus toward but not normally contacting the transparent front viewing panel 40 may be added to provide additional tracking for the scroll and more importantly provide a barrier to inward movement of the front panel, protecting the panel from traveling beyond its breaking point and protecting any other mechanisms disposed in the area between the spools. This feature may be quite important if the apparatus is to be used as scrolling advertising placed along the walls of ice-hockey rink for example, where human body parts may impact at high speed. Many braces may be added in the space between spools depending on the application.

The entire apparatus may be simply hung through holes 41 in the back panel. Depending on the application, other mounting schemes well known in the art may be used without substantially changing the dimensions of the apparatus.

Figure 6:
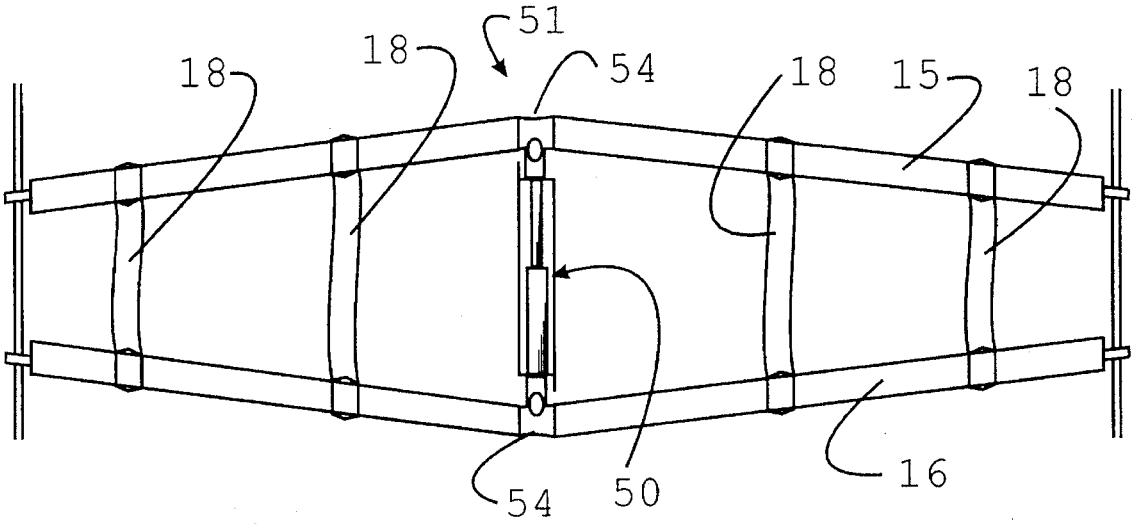
FIG. 6 is a front view diagram of a dual roller spool showing an exaggerated convex crowning shape which the spool attains using the centrally located outwardly biasing separator.

An additional feature of the invention provides for the automatic self alignment of the scroll with respect to the spools. FIG. 6 show that the spool belts 18 keep the floating roller 16 from moving further away from the drive roller 15, and thereby tend to bias the rollers toward each other. A centrally located spring-loaded outwardly biasing separator 50 provides biasing which tends to further separate the two rollers at a medial portion 51 of the spool. These two biasing forces cause the spool to attain a convex shape which is greatly exaggerated in FIG. 6.

Figure 7:
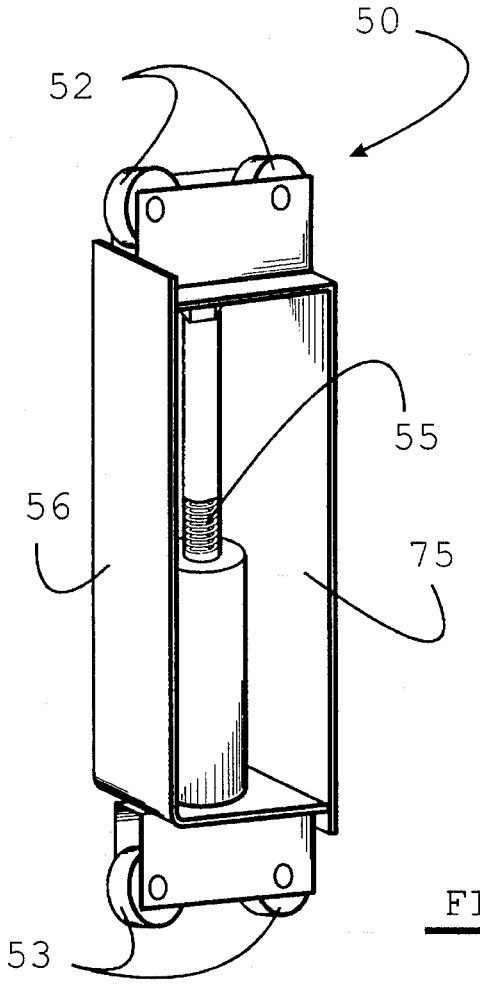
FIG. 7 is a close-up perspective view of the outwardly biasing separator mechanism.

The separator must maintain its position between the rollers and not inhibit their rotation. FIG. 7 shows one means for rotatively engaging the rollers involves two pairs of wheels 52, 53 which are sized and dimensioned to ride in a circumferential groove 54 in each roller. A spring 55 maintains the distance between the two pairs of wheels and thereby the amount of crowning to the spool. A pair of oriented shields 56, 57 prevent the flap end of the scroll from getting caught up in the separator as it travels past with each revolution of the spool in the winding direction. When the spool travels in the un-winding direction, the flap will naturally not get caught up.

Figure 9:
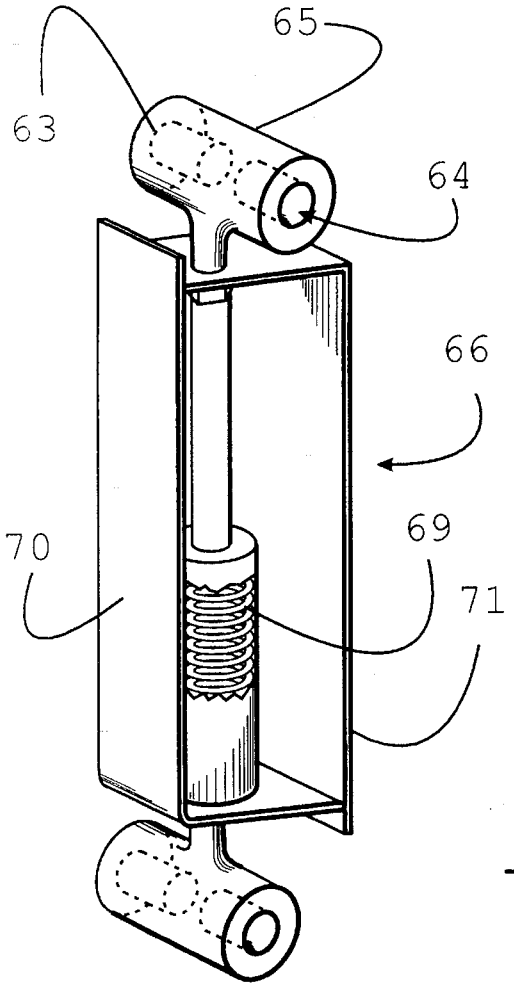
FIG. 9 is a close-up perspective view of the outwardly biasing separator mechanism having bearing structures for rotatively mounting a pair of sub-rollers.
Figure 8:
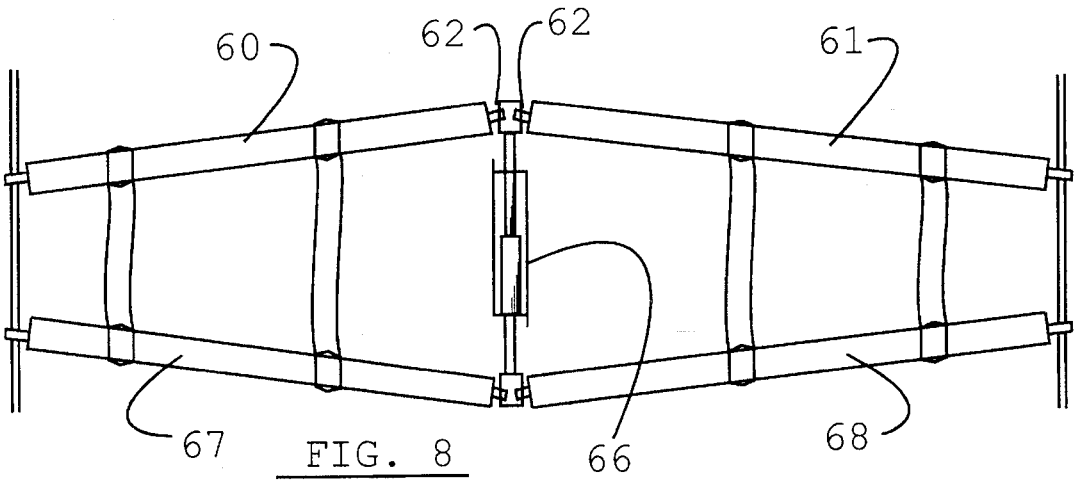
FIG. 8 is a front view of a dual roller spool showing an exaggerated convex crowning shape which the spool attains using split sub-rollers engaging bearings on the centrally located outwardly biasing separator.

FIG. 8 and 9 show another means for the separator to engage the rollers. Here, the drive roller is divided into two distinct sub-rollers 60 and 61. Each sub-roller has an axle 62 for rotatably engaging one of two bearing holes 63 and 64 at the upper end 65 of the separator 66. The floating roller is similarly divided into two sub-rollers 67 and 68. As in the previous design, the separator is spring-loaded 69 to provide outward biasing while remaining compressible and has a pair of oriented shields 70 and 71 to protect the end of the scroll from fouling. Front-to-back stability must be supplied by either a connection point between the apparatus and the separator or the sub-rollers. Alternatively, stability can simply be maintained by contact between the scroll and inside walls of the apparatus. Also, other means for outwardly biasing the floating ends of the floating sub-rollers may be necessary. As with FIG. 6, the degree of crowning is highly exaggerated.

This convex, crown shape operates in the same way as the crowned pulleys described earlier. The crowning allows for more uniform compacting of the scroll onto the spool and allows for automatic recentering of the scroll during each revolution.

Figure 10:
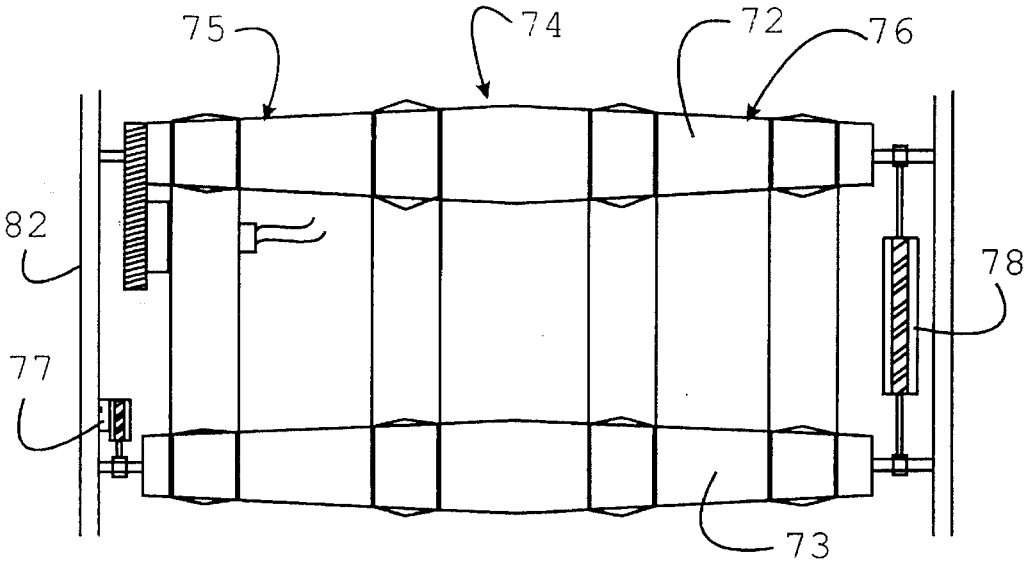
FIG. 10 is a front view of a dual roller spool showing an exaggerated convex crowning shape which the spool attains using tapered rollers.

The separator is not the only means for attaining this crowned shape in the spool. Wheels or bearings attached to the enclosure which ride up against the rollers, or other mechanisms may be designed which force the dual rollers into the crowned configuration may be used. FIG. 10 shows that the rollers 72, 73 themselves may be tapered to have a relatively thick circumference in the middle portion 74 and a thinner circumference toward the edges 75, 76 so as to give the spool an overall crowned shape.

Having a spring loaded separator allows the rollers to compress toward one another. This helps solve another problem encountered with the multi-roller spools. When the scroll travels over the curved portion of the spool, both inner and outer layers have a fixed angular velocity. This means that as the scroll travels between the rollers, the outer layers travel faster than the inner layers. During winding onto a spool, this causes the scroll to "fluff up" or expand without any increase in scroll tightness on the spool. However, during unwinding, this effect causes the scroll to tighten on the spool with each revolution. This in turn leads to compaction, stretching and excessive stress and wear on both surfaces of the scroll. But, with the addition of the compressible separator, the spool is allowed to compress, one roller toward the other, to relieve the tension building in the spool.

Figure 12:
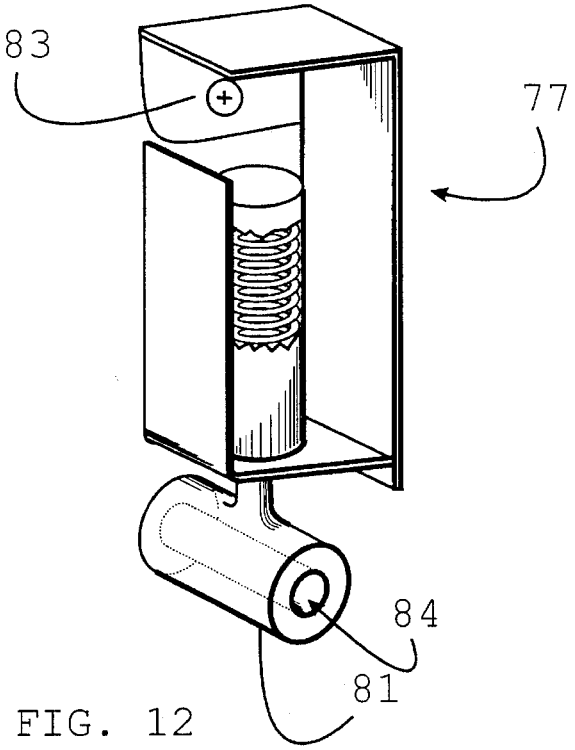
FIG. 12 is a close-up perspective view of the outwardly biasing separator mechanism attachable to a wall of the apparatus having a single bearing structure for rotatively engaging one roller axle.
Figure 11:
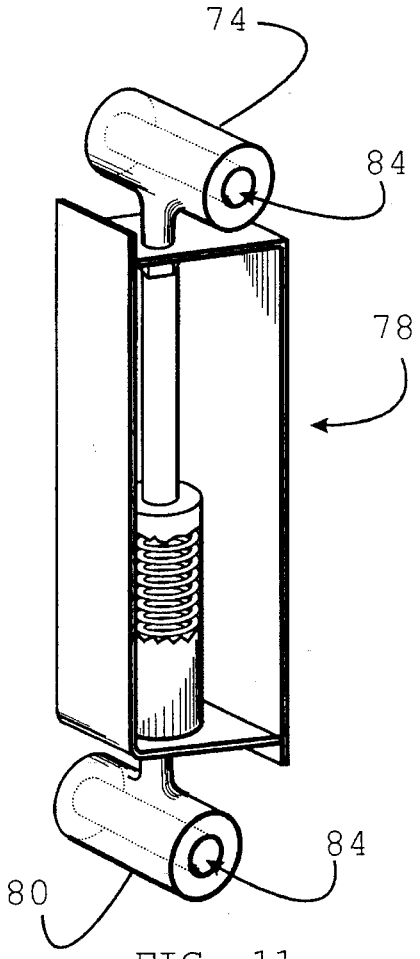
FIG. 11 is a close-up perspective view of the outwardly biasing separator mechanism having bearing structures for rotatively engaging a roller axle.

For this reason, even the tapered rollers can benefit from the addition of the compressible separators. FIG. 10 shows two separators 77, 78, each positioned at either end of the spool to facilitate easier assembly. Each separator rotatively engages an axle on the floating roller 73. FIG. 11 shows a separator 78 which has a bearing 79, 80 at both ends for engaging both the floating roller 73 and the drive roller 72. FIG. 12 shows a separator 77 with only one bearing 81 for engaging the floating roller. This separator attaches to the spool bearing end plate by means of a screw 83. The bearing on both separators comprises a circular hole 84 sized and dimensioned to accept and rotatively engage the axle of a roller. Both separators are spring loaded and have a pair of oriented shields as means to prevent fouling of the end of the scroll within the separator mechanism.

It is clear that the various features disclosed in the different separator designs may be combined in any single apparatus without departing from the invention.

Figure 13:
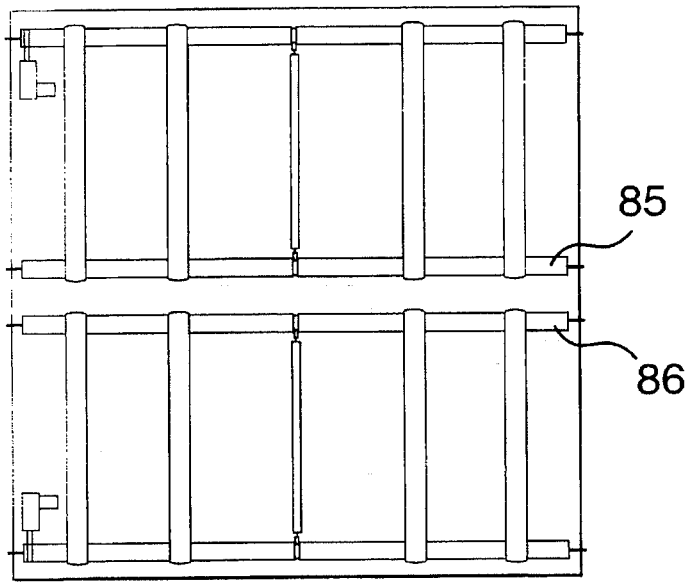
FIG. 13 is a partial cutaway front view of the apparatus showing more medially located floating rollers for maximum spool capacity.

The biggest advantage of the spaced-apart roller spools is that it provides more area for winding the scroll, allowing more banner material to be used in a given apparatus while keeping the apparatus itself shallow. It results in a more efficient use of the space available within the apparatus since previous devices leave a large central area free from use. FIG. 13 shows that the position of the floating rollers 85, 86 can extend toward the center of the apparatus to provide maximum spool capacity.

By reducing the size of the apparatus dimensions, the resulting apparatus is lightweight and provides easy access to all banner display components. The whole front surface of the display apparatus can be the display window.

Figure 14:
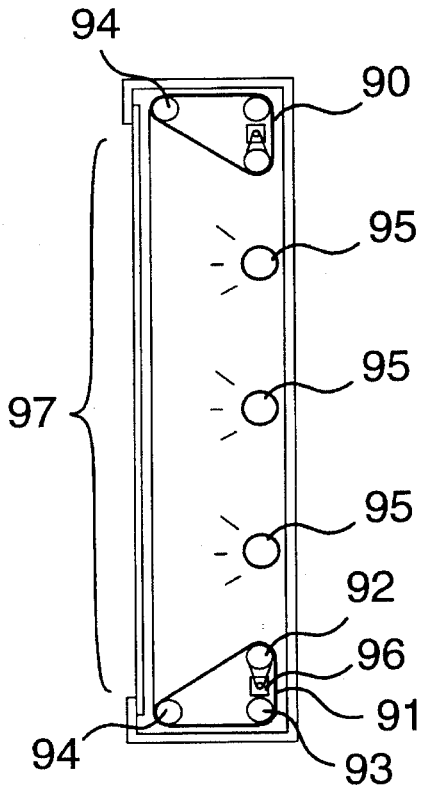
FIG. 14 is a partial cutaway side view of a banner display apparatus using three rollers per spool.

In an alternate embodiment as seen in FIG. 14, a three-roller combination is used to form each spool 90, 91, providing greater storage area between each of the three rollers 92, 93, 94. As with other multi-roller spools, the dominant storage area is between the rollers not the rollers themselves. This arrangement still provides room for the drive motor 96 to be located within the circumferential track of the spool. Since the portion of the scroll being displayed 97 is stretched taut between the two guide rollers 94, this arrangement also would allow a greater area of the displayed banner to be exposed to any back lighting 95.

In another embodiment of the invention, the multiple spooling belts may be replaced by a single belt which is substantially the full width of the spool.

While the preferred embodiments of the invention have been described, modifications can be made and other embodiments may be devised without departing from the spirit of the invention and the scope of the appended claims.

What is claimed is:

1. A scrolling display apparatus which comprises:

a quadrangular shallow enclosure;

first and second rollers rotatively mounted in a side-by-side, space-apart and parallel arrangement inside said enclosure;

third and fourth rollers rotatively mounted in a side-by-side, spaced apart and parallel arrangement inside said enclosure and apart from said first and second rollers wherein said second roller is located between said first and third rollers;

a scroll having a first end portion wound around said first and second rollers and an opposite end portion wound around said third and fourth rollers, leaving a central portion of said scroll spread taut across a display area between said first and fourth rollers;

means for rotating said rollers in a common direction to move said scroll across said display area as said end portions are alternately wound and unwound from said first and second rollers towards said fourth and third rollers and vice-versa; and at least one first resiliently stretchable spool belt mounted around said first and second rollers under said first end portion; and at least one second resiliently stretchable spool belt mounted around said third and fourth rollers under said opposite end portion.

2. The apparatus of claim 1 which further comprises means for automatically loading a scroll onto said first and second rollers.

3. The apparatus of claim 2, wherein said means for automatically loading a scroll comprise:

an elongated slot through said enclosure which extends from one side of said enclosure to an opposite side; said slot allowing access to said first spool belt;

an arcuate deflector screen having a concave surface facing said second roller;

said screen positioned to deflect an end of said scroll toward said second roller.

4. The apparatus of claim 1, wherein said means for rotating comprise:

a first motor mounted between said first and second rollers; and means for coupling said first motor to said first roller.

5. The apparatus of claim 4, wherein said means for coupling comprise:

a drive belt mechanically connected to said motor and mounted around said first roller;

said drive belt having a arcuate zone of contact with said first roller wherein said drive belt has an outer radius of curvature substantially equal to an outer radius of said first roller.

6. The apparatus of claim 5, which further comprises:

an end of said scroll having a substantially oval circumferential movement track between said first and second rollers;

a pair of substantially oval spool bearing end plates, each of which being sized, dimensioned and positioned to lie within said movement track;

said pair of substantially oval spool bearing end plates providing mounting means for said first and second rollers.

7. The apparatus of claim 6, wherein said mounting means comprise each of said spool bearing end plates having:

a first circular hole sized, dimensioned and positioned to provide rotatable engagement of an axial spindle extending from an end of said first roller;

a slot sized, dimensioned and positioned to provide rotatable engagement of an axial spindle extending from an end of said second roller;

said slot allowing limited movement of an engaged spindle toward and away from said first roller.

8. The apparatus of claim 4, wherein said means for rotating further comprises:

a second motor mounted between said third and fourth rollers; and means for coupling said second motor to said fourth roller.

9. The apparatus of claim 1, which further comprises means for maintaining the lateral position of said spool belts.

10. The apparatus of claim 9, wherein said means for maintaining the lateral position comprise:

a first pulley positioned on said first roller;

a second pulley positioned on said second roller substantially adjacent to said first pulley;

each of said pulleys having a generally hollow cylindrical shape having two open ends with an outer diameter longer in the center and shorter at both ends.

11. The apparatus of claim 10, wherein each of said pulleys is made of resilient material and is sized and dimensioned to allow its position on one said rollers to be changed by hand.

12. The apparatus of claim 1, which further comprises means for maintaining the lateral position of said scroll within said apparatus.

13. The apparatus of claim 12, wherein said means for maintaining the lateral position of said scroll comprise:

means for separating adjacent medial portions of said first and second rollers to a first distance;

said first distance being greater than a second distance separating first adjacent end portions of said first and second rollers; and said first distance being greater than a third distance separating second adjacent end portions of said first and second rollers.

14. The apparatus of claim 13, wherein said means for separating comprise:

a separator comprising:

a first end having means for rotatively engaging said first roller;

a second end having means for rotatively engaging said second roller; and resilient means for resisting compression of said first and second ends toward each other.

15. The apparatus of claim 14, wherein said means for rotatively engaging said second roller comprise:

a bearing having a cylindrical hole sized and dimensioned to rotatively engage an axial spindle positioned on said second roller.

16. The apparatus of claim 14, wherein said separator further comprises:

first and second protective shields sized dimensioned and positioned to prevent an end flap portion of said scroll from catching on any portion of said separator.

17. The apparatus of claim 12, wherein said means for maintaining the lateral position of said scroll comprise:

said first and third rollers having a tapered circumference, with an outer diameter longer at a medial portion than at both end portions.

18. The apparatus of claim 1, which further comprises:

resiliently compressible means for biasing said first roller away from said second roller.

19. The apparatus of claim 18, wherein said compressible means for biasing comprise:

a first and second separator;

each of said separators comprising:

a first end having means for rotatively engaging said second roller; and means for resiliently resisting compression of said first end toward said first roller.

20. The apparatus of claim 1, which further comprises:

a substantially transparent front viewing panel dimensioned to cover said display area;

at least one rigid brace attached to an inner surface of a back panel of said enclosure;

said brace extending toward but not contacting said front viewing panel; and, said brace restricting movement of said front viewing panel toward said back of said apparatus.

21. The apparatus of claim 1, wherein said first and second resiliently stretchable spool belts have a width substantially equal to the width of said scroll.

22. A scrolling display apparatus which comprises:

a substantially quadrangular shallow enclosure having top and bottom ends and a front viewing window;

a first scroll pick-up spool positioned adjacent to said top end of said enclosure;

a second scroll pick-up spool positioned adjacent to said bottom end of said enclosure;

said first and second spools positioned in a side-by-side, space-apart and parallel arrangement inside said enclosure;

each of said spools comprising:

a rotatively mounted drive roller;

a rotatively mounted floating roller positioned in a side-by-side, space-apart and parallel arrangement with said drive roller;

a scroll having a first end portion wound around said first spool and an opposite end portion wound around said second spool, leaving a central portion of said scroll spread taut between said first and second spools; and means for rotating said rollers in a common direction to move said scroll between said spools as said end portions are alternately wound and unwound from said first spool towards said second spool and vice-versa;

wherein each of said spools comprises:

at least one first resiliently stretchable spool belt mounted around said drive and floating rollers.

23. A scrolling display apparatus which comprises:

first and second scroll pickup spools;

a scroll having a first end portion wound upon said first spool and an opposite end portion wound upon said second spool;

wherein said first spool comprises:

first and second rollers rotatively mounted to said apparatus in a substantially side-by-side, spaced-apart arrangement;

at least one spool belt mounted around said rollers under said first end portion; and means for rotating said rollers in a common direction to wind said first end portion onto said first spool.

24. The apparatus of claim 23, wherein said second spool comprises:

third and fourth rollers rotatively mounted in a substantially side-by-side, spaced-apart arrangement;

at least one spool belt mounted around said third and fourth rollers under said opposite end portion; and means for rotating said third and fourth rollers in a common direction to wind said opposite end portion onto said second spool.

25. The apparatus of claim 23, which further comprises means for automatically loading said scroll onto said first spool.

26. The apparatus of claim 23, wherein said means for rotating comprise:

a first motor mounted to said apparatus; and means for coupling said first motor to said first roller.

27. The apparatus of claim 26, wherein said means for coupling comprise:

a drive belt mechanically connected to said motor and mounted around said first roller;

said drive belt having a arcuate zone of contact with said first roller wherein said drive belt has an outer radius of curvature substantially equal to an outer radius of said first roller.

28. The apparatus of claim 23, which further comprises:

a first end of said scroll having a substantially oval circumferential movement track between said first and second rollers;

a pair of substantially oval spool bearing end plates, each of which being sized, dimensioned and positioned to lie within said movement track;

said pair of substantially oval spool bearing end plates providing said mounting means for said first and second rollers.

29. The apparatus of claim 23, which further comprises means for maintaining the lateral position of said spool belt.

30. The apparatus of claim 29, wherein said means for maintaining the lateral position comprise:

a first pulley positioned on said first roller;

a second pulley positioned on said second roller substantially adjacent to said first pulley;

each of said pulleys having a generally hollow cylindrical shape having two open ends with an outer diameter longer in the center and shorter at both ends.

31. The apparatus of claim 23, which further comprises:

resiliently compressible means for biasing said first roller away from said second roller.

* * * * *